US005989491A

United States Patent [19]

Isomoto et al.

[11] Patent Number: 5,989,491

[45] Date of Patent: Nov. 23, 1999

[54] OXIDE DISPERSION STRENGTHENED HEAT RESISTING POWDER METALLURGY ALLOY AND PROCESS FOR PRODUCING THE SAME

[75] Inventors: Tatsuro Isomoto; Tadanori Kida, both of Himeji, Japan

[73] Assignee: Sanyo Special Steel Co., Ltd., Hyogo-Ken, Japan

[21] Appl. No.: 08/834,554

[22] Filed: Apr. 4, 1997

[30] Foreign Application Priority Data

Apr. 10, 1996 [JP] Japan ..... 8-088107
Oct. 28, 1996 [JP] Japan ..... 8-284508

[51] Int. Cl.[6] ..... B22F 3/00

[52] U.S. Cl. ..... 419/19; 419/20; 75/338

[58] Field of Search ..... 419/19, 20; 75/338

[56] References Cited

U.S. PATENT DOCUMENTS

| | | | |
|---|---|---|---|
| 3,615,381 | 10/1971 | Hammond et al. | 419/20 |
| 4,599,214 | 7/1986 | Luton | 419/19 |
| 4,668,290 | 5/1987 | Wang et al. | 75/235 |
| 4,714,468 | 12/1987 | Wang et al. | 623/16 |
| 5,073,409 | 12/1991 | Anderson et al. | 75/338 |

FOREIGN PATENT DOCUMENTS

| | | |
|---|---|---|
| 0132371 | 1/1985 | European Pat. Off. . |
| 3-064424 | 3/1991 | Japan . |
| 5-043976 | 2/1993 | Japan . |
| 8-013008 | 1/1996 | Japan . |
| 2256202 | 12/1992 | United Kingdom . |

*Primary Examiner*—George Wyszomierski
*Attorney, Agent, or Firm*—Birch, Stewart, Kolasch & Birch, LLP

[57] ABSTRACT

A process for producing an oxide dispersion strengthened heat resisting powder metallurgy alloy, characterized in that (1) zirconium and/or a rare earth element, such as yttrium, cerium, or lanthanum, are previously added as an oxide former element to a molten mother alloy, (2) an atomizing gas composed of an argon or nitrogen gas containing not more than 5.0% by volume of oxygen is used in the step of gas-atomizing the molten mother alloy, and (3) in the step of consolidating and molding the gas-atomized alloy powder by rolling, forging, HIP, or hot extrusion, the alloy powder is sieved to a particle diameter of not more than 110 $\mu$m before this step. The oxide dispersion strengthened heat resisting powder metallurgy alloy is characterized in that (1) zirconium and/or a rare earth element, such as yttrium, cerium, or lanthanum, are contained in an amount of 0.05 to 3.0% by weight and (2) the powder metallurgy consolidated, molded product prepared by consolidation of the powdery metallurgy alloy contains 0.01 to 0.5% by weight of oxygen.

24 Claims, No Drawings

OXIDE DISPERSION STRENGTHENED HEAT RESISTING POWDER METALLURGY ALLOY AND PROCESS FOR PRODUCING THE SAME

FIELD OF THE INVENTION

The present invention relates to an oxide dispersion strengthened heat resisting powder metallurgy alloy, possessing excellent oxidation resistance and heat resisting strength, for use at high temperatures such as in boiler tubes for power generation or the like, core tubes for heat treatment furnaces, reaction tubes for chemical plants, skid rails for heating furnaces and the like, and a process for producing the same.

BACKGROUND OF THE INVENTION

For the conventional iron-base, nickel-base, cobalt-base, or chromium-base alloy, a large amount of an alloying element, such as molybdenum or tungsten, is incorporated in order to impart heat resistance. Significant segregation of these additive elements results in deteriorated hot workability and makes it difficult to produce members in a good yield. For this reason, a method has been developed which comprises the steps of: rapidly solidifying a material having the same constituents as described above by gas atomization or the like to powder the material, thereby minimizing the segregation; encapsulating the resultant alloy powder; and performing consolidation and molding by rolling, forging, HIP (high temperature hydrostatic compression), hot extrusion or the like.

The powder metallurgy alloy produced by consolidation and molding in this way, however, has a problem that, as compared with the material, having the same constituents, produced by the conventional forging-hot working process, the strength decreases with increasing the service temperature due to lower grain size or the like.

For this reason, a material produced by consolidation and molding of an alloy powder, produced by mechanically alloying an oxide powder, such as yttria, with a mother alloy by means of a ball mill or the like has been used on a commercial scale. The mechanical alloying method requires a treatment time of several tens of hours in order to offer good properties, posing problems such as increased cost and increased quality variation.

Japanese Patent Laid-Open No. 13008/1996 discloses a process for producing a fine powder of an oxide dispersion strengthened alloy, wherein reinforcing particles of an oxide are incorporated into a molten bath of a mother alloy followed by atomization. However, it is difficult to continuously and steadily introduce the oxide during the atomization, so that in fact many technical problems to be solved are left.

SUMMARY OF THE INVENTION

An object of the present invention is to provide a powder metallurgy heat resisting alloy and a powder metallurgy consolidated, molded product having excellent high temperature strength, using a production process which enables an oxide dispersion strengthened heat resisting powder metallurgy alloy to be inexpensively mass-produced.

The process for producing an oxide dispersion strengthened heat resisting powder metallurgy alloy according to the present invention is characterized in that (1) zirconium and/or a rare earth element, such as yttrium, cerium, or lanthanum, are previously added as an oxide former element to a molten mother alloy, (2) an atomizing gas composed of an argon or nitrogen gas containing not more than 5.0% by volume of oxygen is used in the step of gas-atomizing the molten mother alloy, and (3) in the step of consolidating and molding the gas-atomized alloy powder by rolling, forging, HIP, or hot extrusion, the alloy powder is sieved to a particle diameter of not more than 110 $\mu$m before this step.

The oxide dispersion strengthened heat resisting powder metallurgy alloy according to the present invention is characterized in that (1) zirconium and/or a rare earth element, such as yttrium, cerium, or lanthanum, are contained in an amount of 0.05 to 3.0% by weight and (2) the powder metallurgy consolidated, molded product prepared by consolidation of the powder metallurgy alloy contains 0.01 to 0.5% by weight of oxygen.

According to the present invention, zirconium and/or a rare earth element, such as yttrium, cerium, or lanthanum, combine with oxygen to form oxides which are finely dispersed to provide a powder metallurgy alloy or a powder metallurgy consolidated, molded product having excellent high temperature strength and creep rupture strength.

DETAILED DESCRIPTION OF THE INVENTION

The present inventors have noted the fact that fine dispersion of fine particles of an oxide in an oxide dispersion strengthened heat resisting powder metallurgy alloy enhances high temperature strength and creep rupture strength in addition to fundamental heat resisting properties inherent in heat resisting alloys, and have made various studies based on this fact.

As a result, they have found that, in the dissolution of the mother alloy and the rapid solidification at the time of atomization, a rare earth element, such as zirconium, yttrium, cerium, or lanthanum, combines with oxygen to form a fine oxide which is present in the interior or surface of the alloy powder. Further, they have found that the oxide remains homogeneously dispersed even after consolidation and molding of the alloy powder, providing a material having excellent high temperature strength.

Furthermore, they have found that oxides of aluminum, silicon, manganese, chromium and the like have a relatively large size, causative of a deterioration in high temperature strength. Furthermore, it has been found that presence of zirconium and a rare earth element in the molten mother alloy permits these elements to preferentially combine with oxygen to form oxides, avoiding the formation of oxides of aluminum, silicon, manganese, and chromium which adversely affect the high temperature strength.

The process for producing an oxide dispersion strengthened heat resisting powder metallurgy alloy according to the present invention is characterized in that (1) zirconium and/or a rare earth element, such as yttrium, cerium, or lanthanum, are previously added as an oxide former element to a molten mother alloy, (2) an atomizing gas composed of an argon or nitrogen gas containing not more than 5.0% by volume of oxygen is used in the step of gas-atomizing the molten mother alloy, and (3) in the step of consolidating and molding the gas-atomized alloy powder by rolling, forging, HIP, or hot extrusion, the alloy powder is sieved to a particle diameter of not more than 110 μm before this step.

The oxide dispersion strengthened heat resisting powder metallurgy alloy according to the present invention is prepared by the above process and characterized in that (1) zirconium and a rare earth element, such as yttrium, cerium, or lanthanum, are contained in an amount of 0.05 to 3.0% by weight, preferably 0.05 to 1.0% by weight, and (2) the powder metallurgy consolidated, molded product prepared by consolidation of the powder metallurgy alloy contains 0.01 to 0.5% by weight, preferably 0.01 to 0.1% by weight, of oxygen.

Indispensable constituent features of the present invention will be described.

Addition of zirconium and rare earth element: zirconium and rare earth elements, such as yttrium, cerium, and lanthanum, form fine oxides. The zirconium oxide and oxides of rare earth elements are finely dispersed in the interior of the alloy, improving the high temperature strength. Further, the presence of these elements in the molten mother alloy has the effect of inhibiting the formation of relatively large oxides of aluminum, silicon, manganese, and chromium. When the total amount of these elements is less than 0.05% by weight, the amount of the oxides formed is not sufficient to contribute to an increase in high temperature strength. On the other hand, when it exceeds 3.0% by weight, the amount of relatively large oxides is increased, adversely affecting the high temperature strength and resulting in lowered toughness at room temperature. For this reason, the content is suitably 0.05 to 3.0% by weight, preferably 0.05 to 1.0% by weight.

Oxygen content: Oxygen is an indispensable element which combines with an oxide former element, such as zirconium or a rare earth element, during the atomization to form an oxide on the surface or interior of the alloy powder, improving the high temperature strength. When the oxygen content is less than 0.01% by weight, the amount of the oxide formed is not sufficient to contribute to an increase in high temperature strength. On the other hand, when it exceeds 0.50% by weight, the amount of the oxides of aluminum and titanium is excessively large, leading to a fear of causing a deterioration in high temperature strength. For this reason, the oxygen content is suitably 0.01 to 0.5% by weight, preferably 0.01 to 0.1% by weight.

Aluminum and titanium contents: Addition of aluminum and titanium in an excessively large amount results in the formation of oxides, which do not contribute to the high temperature strength, such as alumina and titania even in the presence of rare earth elements. For this reason, the aluminum content and the titanium content are each limited to not more than 2.0% by weight.

Oxygen content of atomizing gas: In the atomization of the molten mother alloy, incorporation of oxygen into the atomizing gas, such as argon or nitrogen, enables oxides to be formed in a larger amount than usual in the interior or on the surface of the alloy powder. When the oxygen content of the atomizing gas is excessively large, there is a fear of causing explosion. Therefore, the upper limit of the content of oxygen in the atomizing gas used in the present invention is 5.0% by volume.

Particle diameter of alloy powder: Particles of the alloy powder produced by gas atomization of the molten mother alloy greatly vary in diameter, and the particle diameter widely ranges from a small value of about several μm to a large value of about 1000 μm. Further, the surface of the alloy powder has an oxide layer which is finely dispersed at the time of solidification and molding. Therefore, the smaller the particle diameter of the alloy powder to be solidified and molded, the larger the amount of the oxide which can be dispersed in the powder metallurgy alloy material after consolidation and molding. For this reason, the alloy powder used in the present invention is limited to one which has been sieved to a particle diameter of not more than 110 μm.

DESCRIPTION OF PREFERRED EMBODIMENTS

EXAMPLE 1

During gas atomization, a rare earth element or zirconium was added as a misch metal or a ferro-alloy to a melting crucible, and gas atomization was performed to produce powders. The powders were encapsulated, the capsules were then vacuum-deaerated, heated to a predetermined temperature, and then consolidated and molded at 1200° C. by hot hydrostatic pressing or by hot extrusion at an extrusion ratio of 8:1 to produce 30-φ rod materials.

The materials thus obtained were heat-treated under predetermined conditions and worked into specimens with 6-φ gauge diameter which were then subjected to a creep rupture test. The test was performed at 980° C. with the stress applied to the specimen being varied, and the stress value, which provides a service life of 1000 hr, i.e., 1000-hr rupture strength, was determined by interpolation.

Materials, having the same constituents as the powder metallurgy alloy materials of the present invention, produced by the melt process and powder metallurgy materials without addition of zirconium and the rare earth element were used as comparative alloys.

Constituents and compositions of the powder metallurgy alloys of the present invention and comparative alloys are summarized in Table 1. Nos. 1 to 8 are powder metallurgy alloys of the present invention, and Nos. 9 to 13 are comparative materials which have been produced by the melt process and respectively have the same compositions as Nos. 1, 2, 4, 6, and 7. Nos. 14 to 20 are comparative powder metallurgy materials which respectively have the same compositions as Nos. 1, 2, 3, 4, 5, 6, and 8, except that neither rare earth element nor zirconium was incorporated. Nos. 21, 22, and 23 are comparative powder metallurgy materials which respective comprise the same basic constituents as Nos. 4, 6, and 6, except that the rare earth element content or the aluminum or titanium content was larger.

TABLE 1

Chemical compositions of powder metallurgy alloys of the present invention and comparative alloys (wt %)

| Alloy No. | C | Si | Mn | Ni | Cr | Mo | W | Nb | Co | Fe | Ti | Al | Rare earth element | Zr | B | O | N | |
|---|---|---|---|---|---|---|---|---|---|---|---|---|---|---|---|---|---|---|
| Al-loy of inv. | | | | | | | | | | | | | | | | | | |
| 1 | 0.05 | 0.2 | 1.2 | 9.2 | 18.4 | — | — | — | — | bal. | 0.02 | 0.05 | 0.5(Y) | — | — | 0.02 | 0.05 | Powder metallurgy material |
| 2 | 0.08 | 0.5 | 0.3 | 20.2 | 25.3 | — | — | — | — | bal. | 0.03 | 0.02 | 0.3(Y) 0.2(Ce) | 0.2 | 0.003 | 0.08 | 0.03 | |
| 3 | 0.06 | 0.4 | 0.6 | 0.4 | 25.5 | 1.2 | — | — | — | bal. | 0.04 | 0.35 | 0.5(Y) 0.3(La) | 0.1 | — | 0.02 | 0.22 | |
| 4 | 0.09 | 0.2 | 0.5 | bal. | 22.5 | 9.1 | 0.5 | — | 0.6 | 15.8 | 0.2 | 0.10 | 0.6(Y) | 0.1 | 0.004 | 0.03 | 0.05 | |
| 5 | 0.04 | 0.2 | 0.2 | bal. | 21.6 | 9.3 | 0.3 | 3.6 | 0.5 | 2.5 | 0.3 | 0.1 | 0.5(Ce) | 0.2 | — | 0.04 | 0.02 | |
| 6 | 0.04 | 0.2 | 0.3 | 59.8 | 22.8 | — | 0.6 | — | 0.6 | bal. | 0.4 | 1.3 | 0.5(La) 0.1(Ce) | 0.1 | 0.002 | 0.03 | 0.05 | |
| 7 | 0.11 | 0.3 | 0.5 | 22.3 | 22.5 | — | 14.5 | — | bal. | 2.8 | 0.04 | 0.3 | 0.5(La) | — | 0.003 | 0.07 | 0.08 | |
| 8 | 0.10 | 0.3 | 0.8 | 1.5 | bal. | 0.8 | — | — | — | 8.5 | 0.3 | 0.1 | 0.08(Y) | — | — | 0.04 | 0.09 | |
| Comp. alloy | | | | | | | | | | | | | | | | | | |
| 9 | 0.05 | 0.2 | 1.3 | 9.5 | 18.2 | — | — | — | — | bal. | 0.03 | 0.06 | 0.6(Y) | — | — | 0.004 | 0.05 | Material produced by melt process |
| 10 | 0.08 | 0.5 | 0.4 | 20.5 | 25.8 | — | — | — | — | bal. | 0.04 | 0.06 | 0.4(Y) 0.3(Ce) | 0.2 | 0.004 | 0.004 | 0.06 | |
| 11 | 0.09 | 0.2 | 0.6 | bal. | 22.8 | 9.3 | 0.6 | — | 0.7 | 15.4 | 0.3 | 0.15 | 0.7(Y) | 0.2 | 0.003 | 0.004 | 0.02 | |
| 12 | 0.05 | 0.3 | 0.4 | 59.2 | 23.0 | — | 0.5 | — | 0.4 | bal. | 0.5 | 1.6 | 0.7(La) 0.1(Ce) | 0.1 | 0.004 | 0.003 | 0.01 | |
| 13 | 0.11 | 0.4 | 0.6 | 22.4 | 22.2 | — | 14.3 | — | bal. | 2.7 | 0.06 | 0.4 | 0.7(La) | — | 0.003 | 0.004 | 0.08 | |
| 14 | 0.05 | 0.2 | 1.3 | 9.5 | 18.2 | — | — | — | — | bal. | 0.02 | 0.04 | — | — | — | 0.02 | 0.05 | Powder metallurgy material |
| 15 | 0.08 | 0.4 | 0.4 | 20.5 | 25.8 | — | — | — | — | bal. | 0.03 | 0.04 | — | — | 0.003 | 0.02 | 0.06 | |
| 16 | 0.05 | 0.3 | 0.5 | 0.3 | 25.8 | 1.3 | — | — | — | bal. | 0.03 | 0.49 | — | — | — | 0.03 | 0.22 | |
| 17 | 0.09 | 0.2 | 0.4 | bal. | 22.8 | 9.3 | 0.5 | — | 0.7 | 15.1 | 0.6 | 0.10 | — | — | 0.003 | 0.03 | 0.05 | |
| 18 | 0.05 | 0.2 | 0.5 | bal. | 21.8 | 9.2 | 0.4 | 3.7 | 0.4 | 2.8 | 0.3 | 0.2 | — | — | — | 0.01 | 0.03 | |
| 19 | 0.05 | 0.3 | 0.5 | 60.7 | 21.8 | — | 0.5 | — | 0.7 | bal. | 0.9 | 1.1 | — | — | 0.002 | 0.01 | 0.03 | |
| 20 | 0.11 | 0.5 | 0.6 | 1.4 | bal. | 0.7 | — | — | — | 8.0 | 0.3 | 0.2 | — | — | — | 0.01 | 0.02 | |
| 21 | 0.07 | 0.4 | 0.5 | bal. | 23.0 | 9.5 | 0.3 | — | 0.9 | 15.7 | 0.4 | 0.10 | 0.7(Y) 0.5(La) | 0.1 | 0.003 | 0.08 | 0.07 | |
| 22 | 0.06 | 0.2 | 0.3 | 60.4 | 23.5 | — | — | — | — | bal. | 0.6 | 2.5 | 0.2(Y) | — | 0.003 | 0.04 | 0.03 | |
| 23 | 0.05 | 0.2 | 0.4 | 60.9 | 22.8 | — | — | — | — | bal. | 2.3 | 0.5 | 0.1(Y) | — | 0.003 | 0.04 | 0.03 | |

Data on 1000-hr rupture strength at 980° C. determined by interpolation in the creep rupture test of the powder metallurgy materials listed in Table 1 are summarized in Table 2. All the alloys of the present invention have high strength values. The results of comparison of the alloys of the present invention with materials, having the same compositions as the alloys of the present invention, produced by the melt process and powder metallurgy materials without addition of zirconium and rare earth element are also summarized in Table 2.

From Table 2, it is apparent that Nos. 1, 2, 4, 6 and 7, which are alloys of the present invention, have about 3- to 4-fold larger strength than the materials, having the same compositions as the alloys of the present invention, produced by the melt process. Further, it is also apparent that Nos. 1, 2, 3, 4, 5, 6, and 8, which are alloys of the present invention, have about 5- to 7-fold larger strength than the powder metallurgy materials without addition of rare earth element and zirconium. Furthermore, as is apparent from Table 2, no significant improvement in strength can be obtained even with addition of the rare earth element because the amount of the rare earth element added is excessively large for the comparative alloy No. 21, the aluminum content is excessively high for the comparative alloy No. 22, and the titanium content is excessively high for the comparative alloy No. 23.

TABLE 2

Creep rupture strength of powder metallurgy alloys of the present invention and comparative alloys

| Alloy No. | | 1000-hr rupture stress at 980° C. (kgf/mm 2) | Strength ratio based on material, having the same composition, produced by the melt process | Strength ratio based on comparative powder metallurgy material | |
|---|---|---|---|---|---|
| Alloy of inv. | 1 | 1.2 | 3.0 | 6.0 | Powder metallurgy material |
| | 2 | 2.3 | 3.8 | 7.0 | |
| | 3 | 0.6 | — | 6.1 | |
| | 4 | 4.3 | 3.1 | 6.1 | |
| | 5 | 5.4 | — | 6.0 | |
| | 6 | 4.5 | 3.2 | 5.6 | |
| | 7 | 7.1 | 3.1 | — | |
| | 8 | 3.3 | — | 6.6 | |
| Comp. alloy | 9 | 0.4 | 1 | — | Material produced by melt process |
| | 10 | 0.6 | 1 | — | |
| | 11 | 1.4 | 1 | — | |
| | 12 | 1.4 | 1 | — | |
| | 13 | 2.3 | 1 | — | |
| | 14 | 0.2 | — | 1 | Powder metallurgy material |
| | 15 | 0.4 | — | 1 | |
| | 16 | 0.1 | — | 1 | |
| | 17 | 0.7 | — | 1 | |

TABLE 2-continued

Creep rupture strength of powder metallurgy alloys of the present invention and comparative alloys

| Alloy No. | 1000-hr rupture stress at 980° C. (kgf/mm 2) | Strength ratio based on material, having the same composition, produced by the melt process | Strength ratio based on comparative powder metallurgy material |
|---|---|---|---|
| 18 | 0.9 | — | 1 |
| 19 | 0.8 | — | 1 |
| 20 | 0.5 | — | 1 |
| 21 | 1.2 | — | — |
| 22 | 1.1 | — | — |
| 23 | 0.9 | — | — |

EXAMPLE 2

Alloy powders were produced by adding yttrium to molten mother alloy baths and atomizing the molten alloys with the aid of an atomizing gas containing 0.02 to 3.5% by volume of oxygen. For comparison, molten mother alloy baths without addition of yttrium were used to produce alloy powders by the conventional atomization using a gas not containing oxygen.

The powders were encapsulated after sieving or without sieving, vacuum-deaerated, heated to a predetermined temperature, and hot-extruded at an extrusion ratio of 8:1 to produce 30-ϕ steel bars. These materials were heat-treated under predetermined conditions to prepare specimens which were then subjected to a creep rupture test. The test was performed at 980° C. with the stress applied to the specimen being varied, and the stress value, which provides a service life of 1000 hr, i.e., 1000-hr rupture strength, was determined by interpolation.

Chemical compositions of the powders after the gas atomization are summarized in Table 3. Powders A to D are powders produced by adding yttrium and then performing atomization, and powders E and F are powders produced without addition of yttrium. Powders B, C, D and F are powders produced by atomization with the aid of an atomizing gas containing oxygen. It is apparent that the powders produced by atomization with the aid of an oxygen-containing atomizing gas have higher oxygen content than the powders produced by the conventional gas atomization, suggesting that the oxygen content of the powder increases with increasing the oxygen content of the atomizing gas.

TABLE 3

Chemical compositions of alloy powders after gas atomization (wt %)

| Powder | C | Si | Mn | Ni | Cr | Fe | Y | O | Oxygen concentration of atomized gas (vol %) |
|---|---|---|---|---|---|---|---|---|---|
| A | 0.005 | 0.2 | 1.2 | 10.0 | 19.0 | bal. | 0.61 | 0.009 | — |
| B | 0.005 | 0.2 | 1.0 | 10.1 | 19.2 | bal. | 0.88 | 0.026 | 0.02 |
| C | 0.005 | 0.2 | 0.9 | 9.98 | 19.3 | bal. | 1.56 | 0.162 | 0.5 |
| D | 0.006 | 0.2 | 1.1 | 10.0 | 19.5 | bal. | 2.88 | 0.250 | 3.5 |

TABLE 3-continued

Chemical compositions of alloy powders after gas atomization (wt %)

| Powder | C | Si | Mn | Ni | Cr | Fe | Y | O | Oxygen concentration of atomized gas (vol %) |
|---|---|---|---|---|---|---|---|---|---|
| E | 0.006 | 0.2 | 1.1 | 11.2 | 18.9 | bal. | — | 0.012 | — |
| F | 0.006 | 0.2 | 1.0 | 11.8 | 20.9 | bal. | — | 0.025 | 0.5 |

EXAMPLE 2-1

The oxygen content and the 1000-hr rapture strength of powder metallurgy alloys produced by consolidation and molding of the alloy powders A and E after sieving or without sieving are summarized in Table 4.

The alloy Nos. 1 to 3 specified in Table 4 are alloys produced according to the present invention. As compared with the comparative alloy Nos. 4 and 5 produced using the same powders as in the alloy Nos. 1 to 3, the alloy Nos. 1 to 3 of the present invention, by virtue of sieving, had increased oxygen content and higher rupture strength. The comparative alloy Nos. 6 and 7 are alloys which were produced by consolidation and molding of powders produced by atomization without addition of zirconium or the rare earth element. They are inferior in rupture strength to the alloy No. 7 of which the oxygen content was enhanced by sieving. This is because the formed oxide is not an oxide of zirconium or a rare earth element and, hence, cannot be finely dispersed making it impossible to improve the strength.

The composition of the powder metallurgy alloy after the consolidation and molding remains unchanged from that of the alloy powder, except that, as shown in Table 4, only the oxygen content is increased.

TABLE 4

Properties of powder metallurgy alloys

| Alloy No. | | Powder | Particle diameter of powder (μm) | Oxygen content of consolidation and molding (wt %) | 1000-hr rupture strength (MPa) |
|---|---|---|---|---|---|
| Alloy | 1 | A | Not more than 106 | 0.025 | 21 |
| of | 2 | A | Not more than 63 | 0.029 | 22 |
| inv. | 3 | A | Not more than 37 | 0.031 | 23 |
| Comp. | 4 | A | Not sieved | 0.010 | 12 |
| alloy | 5 | A | Not more than 210 | 0.014 | 13 |
| | 6 | E | Not sieved | 0.016 | 2 |
| | 7 | E | Not more than 37 | 0.026 | 2 |

EXAMPLE 2-2

Analytical values for the oxygen content and the 1000-hr rupture strength of powder metallurgy materials produced by consolidation and molding of alloy powders A, B, C, D, and F are summarized in Table 5. Alloy Nos. 8 to 10 respectively using the alloy powders B, C, and D produced by atomization with the aid of an oxygen-containing atomizing gas have high oxygen content and high rupture strength. The alloy No. 12 has very low rupture strength despite the fact that the oxygen content level is the same as that for the alloy Nos. 8 to 10 of the present invention. This is because the formed oxide is not an oxide of zirconium or a rare earth element and, hence, cannot be finely dispersed making it impossible to improve the strength.

TABLE 5

| Properties of powder metallurgy alloys | | | | | |
|---|---|---|---|---|---|
| Alloy No. | | Powder | Particle diameter of powder (μm) | Oxygen content of consolidation and molding (wt %) | 1000-hr rupture strength (MPa) |
| Alloy | 8 | B | Not sieved | 0.027 | 22 |
| of | 9 | C | Not sieved | 0.188 | 41 |
| inv. | 10 | D | Not sieved | 0.266 | 48 |
| Comp. | 11 | A | Not sieved | 0.010 | 12 |
| alloy | 12 | F | Not sieved | 0.032 | 1 |

EXAMPLE 2-3

Powder metallurgy alloys produced by consolidation and molding of the alloy powders A, B, C, and D after sieving or without sieving are summarized in Table 6.

The alloy Nos. 13 to 16 are alloys produced by sieving powders B, C, and D, produced by atomization with the aid of an oxygen-containing atomizing gas, to a particle diameter of not more than 110 μm. As is apparent from Table 6, the alloys Nos. 13 to 16 have higher oxygen content and rupture strength than the alloy Nos. 18 to 20 which have not been sieved. The alloy No. 17 is an alloy which has been sieved to a particle diameter of not more than 37 μm. For this alloy, however, since the atomization method used was a conventional one, the alloy had low oxygen content and, in addition, lower rupture strength than the alloy Nos. 13 to 16 of the present invention.

TABLE 6

| Properties of powder metallurgy alloys | | | | | |
|---|---|---|---|---|---|
| Alloy No. | | Powder | Particle diameter of powder (μm) | Oxygen content of consolidation and molding (wt %) | 1000-hr rupture strength (MPa) |
| Alloy | 13 | B | Not more than 106 | 0.038 | 32 |
| of | 14 | B | Not more than 74 | 0.046 | 42 |
| inv. | 15 | C | Not more than 106 | 0.264 | 56 |
| | 16 | D | Not more than 106 | 0.342 | 58 |
| Comp. | 17 | A | Not more than 37 | 0.031 | 23 |
| alloy | 18 | B | Not sieved | 0.027 | 22 |
| | 19 | C | Not sieved | 0.188 | 41 |
| | 20 | D | Not sieved | 0.266 | 48 |

What is claimed is:

1. A process for producing an oxide dispersion strengthened heat resisting powder metallurgy alloy, comprising the steps of:

previously adding about 0.05 to 3.0% of at least one oxide former metal selected from the group consisting of zirconium and rare earth elements to a molten mother alloy; gas-atomizing the molten mother alloy by an atomizing gas composed of an argon or nitrogen gas containing not more than 5.0% by volume of oxygen; sieving the resultant alloy powder to a particle diameter of not more than 110 μm; and consolidating and molding the sieved alloy powder by rolling, forging, HIP, or hot extrusion to prepare an oxide dispersion strengthened powder metallurgy alloy.

2. The process according to claim 1, wherein the oxide dispersion strengthened powder metallurgy alloy is an iron-base alloy comprising by weight not more than 0.1% of carbon, not more than 3.0% of silicon, not more than 8.0% of manganese, 2.0 to 28.0% of nickel, 15.0 to 28.0% of chromium, not more than 2.0% of aluminum, not more than 2.0% of titanium, 0.05 to 3.0% of at least one metal selected from the group consisting of zirconium and rare earth elements and 0.01 to 0.5% of oxygen with the balance consisting of iron and unavoidable impurities.

3. The process according to claim 2, wherein the oxide dispersion strengthened powder metallurgy alloy further comprises at least one member selected from the group consisting of by weight not more than 12.0% of molybdenum, not more than 12.0% of cobalt, not more than 5.0% of copper, not more than 3.0% of tungsten, not more than 3.0% of vanadium, not more than 5.0% of niobium, not more than 0.05% of boron, not more than 0.5% of nitrogen, not more than 0.05% of calcium, and not more than 0.05% of magnesium.

4. The process according to claim 2, wherein the rare earth elements are selected from the group consisting of yttrium, cerium and lanthanum.

5. The process according to claim 1, wherein the oxide dispersion strengthened powder metallurgy alloy is an iron-base alloy comprising by weight not more than 0.1% of carbon, not more than 3.0% of silicon, not more than 8.0% of manganese, 15.0 to 28.0% of chromium, not more than 2.0% of aluminum, not more than 2.0% of titanium, 0.05 to 3.0% of at least one metal selected from the group consisting of zirconium and rare earth elements and 0.01 to 0.5% of oxygen with the balance consisting of iron and unavoidable impurities.

6. The process according to claim 5, wherein the oxide dispersion strengthened powder metallurgy alloy further comprises at least one member selected from the group consisting of by weight not more than 5.0% of nickel, not more than 12.0% of molybdenum, not more than 12.0% of cobalt, not more than 5.0% of copper, not more than 3.0% of tungsten, not more than 3.0% of vanadium, not more than 5.0% of niobium, not more than 0.05% of boron, not more than 0.5% of nitrogen, not more than 0.05% of calcium, and not more than 0.05% of magnesium.

7. The process according to claim 5, wherein the rare earth elements are selected from the group consisting of yttrium, cerium and lanthanum.

8. The process according to claim 1, wherein the oxide dispersion strengthened powder metallurgy alloy is a nickel-base alloy comprising by weight not more than 0.1% of carbon, not more than 3.0% of silicon, not more than 8.0% of manganese, 15.0 to 30.0% of chromium, not more than 2.0% of aluminum, not more than 2.0% of titanium, 0.05% to 3.0% of at least one metal selected from the group consisting of zirconium and rare earth elements and 0.01 to 0.5% of oxygen with the balance consisting of nickel and unavoidable impurities.

9. The process according to claim 8, wherein the rare earth elements are selected from the group consisting of yttrium, cerium and lanthanum.

10. The process according to claim 1, wherein the oxide dispersion strengthened powder metallurgy alloy is a chromium-base alloy comprising by weight not more than 0.1% of carbon, not more than 3.0% of silicon, not more than 8.0% of manganese, 2.0 to 30.0% of nickel, not more than 2.0% of aluminum, not more than 2.0% of titanium, 0.05 to 3.0% of at least one metal selected from the group consisting of zirconium and rare earth elements and 0.01 to 0.5% of oxygen with the balance consisting of chromium and unavoidable impurities.

11. The process according to claim 10, wherein the rare earth elements are selected from the group consisting of yttrium, cerium and lanthanum.

12. The process according to claim 8 or 10, wherein the oxide dispersion strengthened powder metallurgy alloy further comprises at least one member selected from the group consisting of by weight not more than 12.0% of molybdenum, not more than 12.0% of cobalt, not more than 15% of iron, not more than 5.0% of copper, not more than 3.0% of tungsten, not more than 3.0% of vanadium, not more than 5.0% of niobium, not more than 0.05% of boron, not more than 0.5% of nitrogen, and not more than 0.05% of calcium.

13. The process according to claim 1, wherein the oxide dispersion strengthened powder metallurgy alloy is a cobalt-base alloy comprising by weight not more than 0.1% of carbon, not more than 3.0% of silicon, not more than 8.0% of manganese, 2.0 to 30.0% of nickel, 15.0 to 30.0% of chromium, not more than 2.0% of aluminum, not more than 2.0% of titanium, 0.05 to 3.0% of at least one metal selected from the group consisting of zirconium and rare earth elements and 0.01 to 0.5% of oxygen with the balance consisting of cobalt and unavoidable impurities.

14. The process according to claim 13, wherein the oxide dispersion strengthened powder metallurgy alloy further comprises at least one member selected from the group consisting of by weight not more than 12.0% of molybdenum, not more than 15% of iron, not more than 5.0% of copper, not more than 3.0% of tungsten, not more than 3.0% of vanadium, not more than 5.0% of niobium, not more than 0.05% of boron, not more than 0.5% of nitrogen, not more than 0.05% of calcium, and not more than 0.05% of magnesium.

15. The process according to claim 13, wherein the rare earth elements are selected from the group consisting of yttrium, cerium and lanthanum.

16. The process according to claim 1, wherein the amount of oxygen in the atomizing gas is 0.02 to 5.0% by volume.

17. The process according to claim 1, wherein an effective amount of oxygen is present in the atomizing gas for increasing the rupture strength in said alloy at increased temperatures.

18. The process according to claim 1, wherein the oxide dispersion strengthened powder metallurgy alloy is an iron-base alloy comprising:

carbon, wherein the amount of carbon is from 0.04 to 0.1% by weight;

silicon, wherein the amount of silicon is from 0.2 to 3.0% by weight;

manganese, wherein the amount of manganese is from 0.2 to 8.0% by weight;

nickel, wherein the amount of nickel is from 2.0 to 28.0% by weight;

chromium, wherein the amount of chromium is from 15.0 to 28% by weight;

aluminum, wherein the amount of aluminum is from 0.02 to 2.0% by weight;

titanium, wherein the amount of titanium is from 0.02 to 2.0% by weight;

at least one metal selected from the group consisting of zirconium and rare earth elements, wherein said at least one metal is present in an amount of from 0.05 to 3.0% by weight; and oxygen, wherein the amount of oxygen is present in an amount of from 0.01 to 0.5% by weight;

wherein the balance consists of iron and unavoidable impurities.

19. The process according to claim 1, wherein the oxide dispersion strengthened powder metallurgy alloy is an iron-base alloy comprising:

carbon, wherein the amount of carbon is from 0.04 to 0.1% by weight;

silicon, wherein the amount of silicon is from 0.2 to 3.0% by weight;

manganese, wherein the amount of manganese is from 0.2 to 8.0% by weight;

chromium, wherein the amount of chromium is from 15.0 to 28% by weight;

aluminum, wherein the amount of aluminum is from 0.02 to 2.0% by weight;

titanium, wherein the amount of titanium is from 0.02 to 2.0% by weight;

at least one metal selected from the group consisting of zirconium and rare earth elements, wherein said at least one metal is present in an amount of from 0.05 to 3.0% by weight; and oxygen, wherein the amount of oxygen is from 0.01 to 0.5% by weight;

wherein the balance consists of iron and unavoidable impurities.

20. The process according to claim 1, wherein the oxide dispersion strengthened powder metallurgy alloy is an nickel-base alloy comprising:

carbon, wherein the amount of carbon is from 0.04 to 0.1% by weight;

silicon, wherein the amount of silicon is from 0.2 to 3.0% by weight;

manganese, wherein the amount of manganese is from 0.2 to 8.0% by weight;

chromium, wherein the amount of chromium is from 15.0 to 30% by weight;

aluminum, wherein the amount of aluminum is from 0.02 to 2.0% by weight;

titanium, wherein the amount of titanium is from 0.02 to 2.0% by weight;

at least one metal selected from the group consisting of zirconium and rare earth elements, wherein said at least one metal is present in an amount of from 0.05 to 3.0% by weight; and oxygen, wherein the amount of oxygen is present in an amount of from 0.01 to 0.5% by weight;

wherein the balance consists of nickel and unavoidable impurities.

21. The process according to claim 1, wherein the oxide dispersion strengthened powder metallurgy alloy is an chromium-base alloy comprising:

carbon, wherein the amount of carbon is from 0.04 to 0.1% by weight;

silicon, wherein the amount of silicon is from 0.2 to 3.0% by weight;

manganese, wherein the amount of manganese is from 0.2 to 8.0% by weight;

nickel, wherein the amount of nickel is from 2.0 to 30.0% by weight;

aluminum, wherein the amount of aluminum is from 0.02 to 2.0% by weight;

titanium, wherein the amount of titanium is from 0.02 to 2.0% by weight;

at least one metal selected from the group consisting of zirconium and rare earth elements, wherein said at least one metal is present in an amount of from 0.05 to 3.0% by weight; and oxygen, wherein the amount of oxygen is present in an amount of from 0.01 to 0.5% by weight;

wherein the balance consists of chromium and unavoidable impurities.

22. The process according to claim 1, wherein the oxide dispersion strengthened powder metallurgy alloy is an cobalt-base alloy comprising:

carbon, wherein the amount of carbon is from 0.04 to 0.1% by weight;

silicon, wherein the amount of silicon is from 0.2 to 3.0% by weight;

manganese, wherein the amount of manganese is from 0.2 to 8.0% by weight;

nickel, wherein the amount of nickel is from 2.0 to 30.0% by weight;

chromium, wherein the amount of chromium is from 15.0 to 30% by weight;

aluminum, wherein the amount of aluminum is from 0.02 to 2.0% by weight;

titanium, wherein the amount of titanium is from 0.02 to 2.0% by weight;

at least one metal selected from the group consisting of zirconium and rare earth elements, wherein said at least one metal is present in an amount of from 0.05 to 3.0% by weight; and oxygen, wherein the amount of oxygen is present in an amount of from 0.01 to 0.5% by weight;

wherein the balance consists of cobalt and unavoidable impurities.

23. The process according to claim 1, wherein the 1000-hr rupture strength at 980° C. of the oxide dispersion strengthened alloy is greater than about 0.6 $kgf/mm^2$.

24. The process according to claim 1, wherein the rare earth elements are selected from the group consisting of yttrium, cerium and lanthanum.

* * * * *